US008384607B2

(12) United States Patent
Minard et al.

(10) Patent No.: US 8,384,607 B2
(45) Date of Patent: Feb. 26, 2013

(54) COMPACT ANTENNA SYSTEM

(75) Inventors: Philippe Minard, Saint Medard sur Ille (FR); Jean-Francois Pintos, Bourgbarre (FR); Philippe Chambelin, Chateaugiron (FR)

(73) Assignee: Thomson Licensing, Issy les Moulineaux (FR)

( * ) Notice: Subject to any disclaimer, the term of this patent is extended or adjusted under 35 U.S.C. 154(b) by 445 days.

(21) Appl. No.: 12/660,848

(22) Filed: Mar. 5, 2010

(65) Prior Publication Data

US 2010/0225553 A1 Sep. 9, 2010

(51) Int. Cl.
*H01Q 13/10* (2006.01)

(52) U.S. Cl. ..... 343/770

(58) Field of Classification Search ..... 343/702, 343/787, 700 MS, 770, 893
See application file for complete search history.

(56) References Cited

U.S. PATENT DOCUMENTS 4,360,813 A * 11/1982 Fitzsimmons ..... 342/350
6,069,590 A * 5/2000 Thompson et al. ..... 343/795
7,230,573 B2 * 6/2007 Lin et al. ..... 343/700 MS
7,642,980 B2 * 1/2010 Louzir et al. ..... 343/767
8,207,903 B2 * 6/2012 Lu et al. ..... 343/767
2002/0149526 A1 10/2002 Tran et al.
2008/0007471 A1 * 1/2008 Goldberg et al. ..... 343/705

OTHER PUBLICATIONS

Aliou Diallo et al., "Study and Reduction of the Mutual Coupling Between Two Mobile Phone PIFAs Operating in the DCS1800 and UMTS Bands", IEEE Tranactions on Antennas and Propagation, IEEE Service Center, Piscataway, NJ, vol. 54, No. 11, Nov. 1, 2006, pp. 3063-3074.
French Search Report date Nov. 12, 2009.

* cited by examiner

*Primary Examiner* — Huedung Mancuso
(74) *Attorney, Agent, or Firm* — Tutunjian & Bitetto, P.C.

(57) ABSTRACT

The present invention relates to an antenna system comprising on a substrate, at least a first and a second printed radiating elements, each supplied by a feed line, with, between the two radiating elements, at least one transmission line comprising a first extremity and a second extremity. The first and the second extremities of the transmission line are respectively coupled to the first and the second radiating elements according to a coupling function with a ratio 1:b, b>1 and a phase $\phi$, linked to the physical difference between the radiating elements, the length of the transmission line bringing a phase difference $\theta$ such that $\theta$ compensates for $\phi$.
The invention applies to antennas compatible with WIFI.

7 Claims, 16 Drawing Sheets

COMPACT ANTENNA SYSTEM

This application claims the benefit, under 35 U.S.C. §119 of French Patent Application 0951441, filed Mar. 6, 2009.

The present invention relates to a compact antenna system, more particularly an antenna system for a wireless communication device, such as multi-standard digital platforms.

BACKGROUND OF THE INVENTION

The digital platforms on the current market offer multi-services through wireless links. Therefore, they must be capable of supporting various standards, especially the standards implemented for wireless high bit rate communications such as the IEEE802.11a, b, g standards, and now the 802.11n standard for the WIFI function. This type of wireless communication also takes place inside closed premises where, in particular, very penalizing electromagnetic wave propagation conditions are observed. To improve the system loss and the bit rate between two wireless devices, a technique known as MIMO (for 'Multiple Output Multiple Input') is used. This technique requires at least two antennas, a good de-correlation as well as a good isolation between the antennas.

To respond to the problem of the isolation between two antennas, the solution typically used is to spatially distance the antennas from each other in order to ensure a sufficient isolation. However, this solution does not allow a compact system to be obtained.

Another solution allowing the isolation between two antennas to be improved has been presented in the article by A. DIALLO, C. LUXEY, Ph. LE THUC, R. STARAJ, G. KOSSIAVAS, entitled "Enhanced two-antenna structures for universal mobile telecommunications system diversity terminal". IET Microwaves, Antennas and Propagation, vol. 2, no 1, p. 93-101, February 2008. This solution proposes to connect two PIFA type antennas, i.e. F-inverted antennas by means of a conductive line. This suspended conductive line is directly connected to the antenna at the antenna short circuit point and can compensate for the electromagnetic coupling existing between the two antennas. This line brings a fraction of the signal from an antenna to the other, which isolates them more or less according to the length of the line.

It has also been proposed to add quarter wave notches between two antennas to increase the isolation between antennas.

SUMMARY OF THE INVENTION

The present invention relates to a specific solution applying to slot type antennas, such as ¼ wave or ½ wave slots, annular slots, tapered slots (TSA, Vivaldi) and also to patch type antennas or other printed antennas.

Therefore, the present invention relates to an antenna system comprising on a substrate, at least a first and a second printed radiating elements, each supplied by a feed line, with, between the two radiating elements, at least one transmission line comprising a first extremity and a second extremity, characterized in that the first and the second extremities of the transmission line are respectively coupled to the first and the second radiating elements according to a coupling function with a ratio 1:b, b>1 and a phase $\phi$, linked among other things to the physical difference between the radiating elements, the length of the transmission line bringing a phase difference $\theta$ such that $\theta$ compensates for $\phi$.

According to a preferential embodiment, the radiating elements are slot type antennas and the transmission line is a slot line. The radiating elements can also be patches and, in this case, the transmission line is a microstrip or a coplanar line.

The coupling function is achieved by positioning a portion of the radiating element parallel to the corresponding end of the transmission line, the distance d between the parts in parallel as well as the length of the parts in parallel determining the parameters of the coupling function.

Moreover, the total length of the transmission line allows the component of the complex signal coming from the other antenna to be minimized, which allows a good isolation between the two slot type radiating elements to be obtained.

BRIEF DESCRIPTION OF THE DRAWINGS

Other characteristics and advantages of the present invention will emerge upon reading the description of a preferential embodiment of the present invention, this description being made with reference to the drawings attached in the appendix, in which.

To simplify the description, the same elements have the same references as the figures.

DETAILED DESCRIPTION OF PREFERRED EMBODIMENTS

Figure 1:
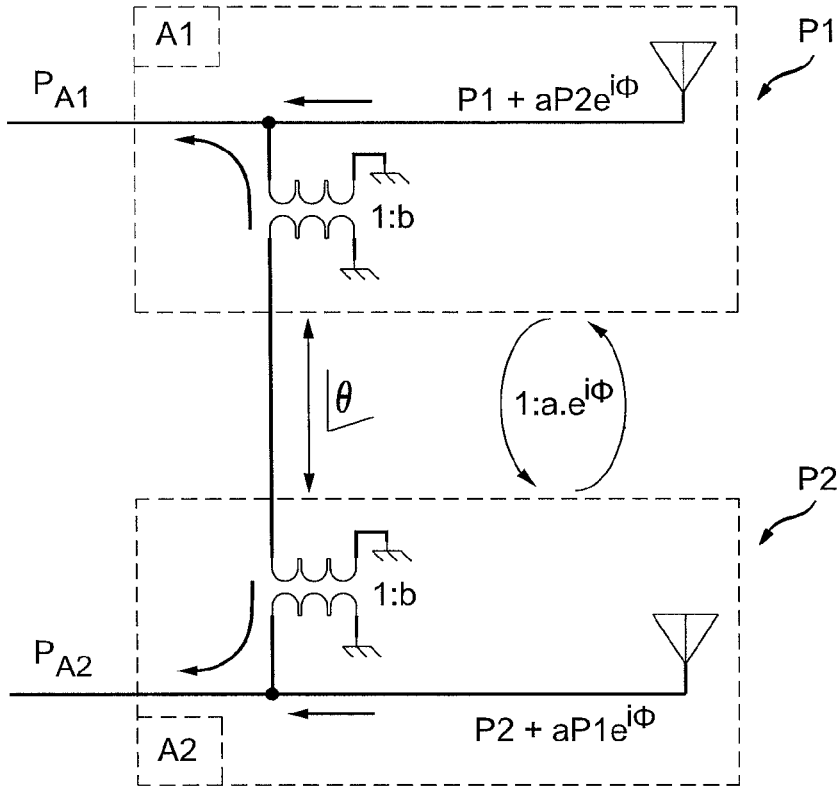
FIG. 1 is a diagrammatic representation of a MIMO system with two antennas explaining the principle of the present invention.

The principle implemented in the present invention will first be explained with reference to FIG. 1 which shows two antennas A1 and A2 using the MIMO technology.

To benefit the most from the contribution of the MIMO technology, each antenna must transmit a signal in a propagation channel specific to it, i.e. at the antenna system level, the antennas must be decoupled and, firstly, isolated. FIG. 1 diagrammatically shows a system with two antennas used for reception. In this case, each antenna receives a differentiated signal P, i.e. P1 on antenna A1 and P2 on antenna A2.

Since the two receiving antennas are close, they couple together according to a ratio 1:a with a>1 and a phase $\phi$ related to the distance between the two antennas. As a result, antenna A1 receives a signal $P1+aP2\,e^{i\Phi}$, likewise antenna A2 receives a signal $P2+aP1\,e^{i\Phi}$.

In accordance with the present invention, an element providing a coupling function is added in the actual structure of each antenna with a coupling ratio 1:b with b>1. These two coupling elements are connected by a transmission line having an electrical length with a phase difference of $\theta$. So, the adjustment of the value of $\theta$ with respect to $\theta$ allows the component of the complex signal from the other antenna to be minimized.

Figure 2:
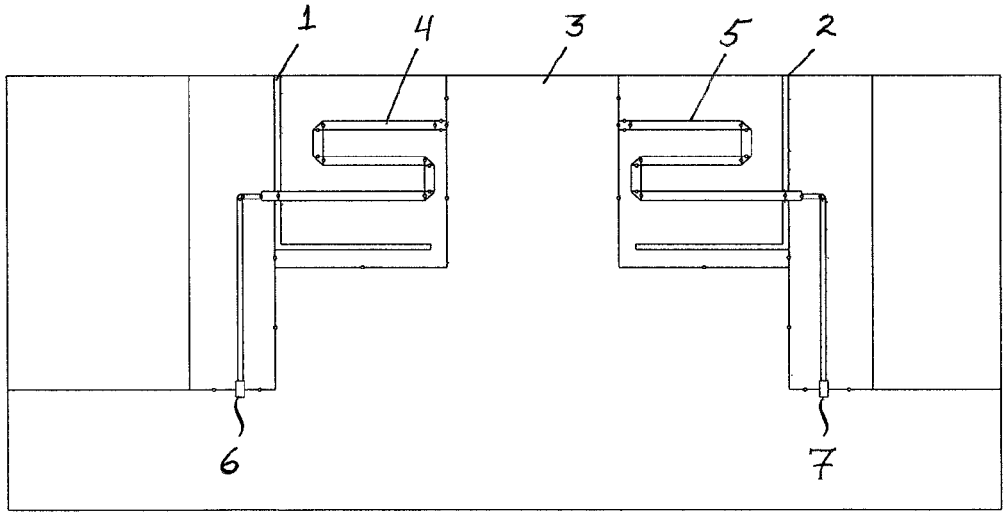
FIG. 2 is a diagrammatic top representation of two slot type radiating elements to which the present invention applies.

According to an embodiment of the present invention and as shown on FIG. 2, the two antennas are achieved with two slot type radiating elements 1, 2. Preferably, slots 1 and 2 have been etched on a metallized substrate 3. The radiating slots, which can be quarter wave or half wave slots, have a length such that $\lambda g/4$ or $\lambda g/2$, $\lambda g$ being the guided wavelength at the operating frequency of the antenna system. To limit their size, slots 1 and 2 are folded at 90°, with their short circuited extremities facing each other. However, other structures can be envisaged without leaving the scope of the present invention, in particular linear slots.

As known and as shown in FIG. 2, the slot type radiating elements 1 and 2 are supplied by electromagnetic coupling by a feed line respectively 4,5 made using microstrip technology on the substrate side opposite to the metallized side. Each microstrip line extends to an excitation port, respectively 6, 7, by a line section 8, 9 forming an impedance transformer. In this case, the line/slot coupling can be achieved as described in the published patent application WO2006/018567 in the name of Thomson Licensing.

A system such as shown in FIG. 2 has been simulated by using the IE3D commercial software (from Zeland) based on the moments method.

The electromagnetic simulations were performed by using an FR4 type substrate with the following characteristics:

Permittivity=4.4.

Loss tangent=0.023.

Substrate thickness=1.4 mm.

Metallization thickness=17.5 μm.

In this case, two radiating elements 1, 2 consisting of quarter wave slots with a slot width of 0.3 mm were produced, the two radiating elements being distant by a length of 29.5 mm.

Figure 3:
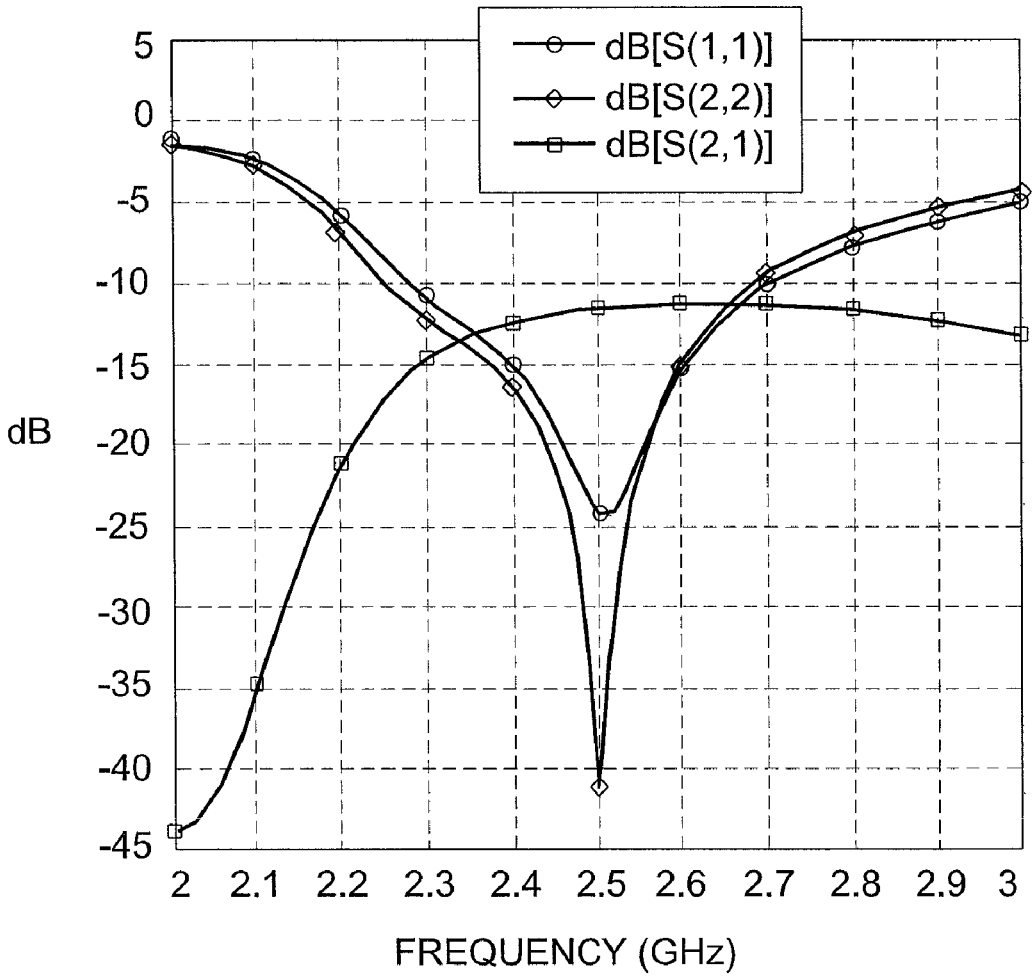
FIG. 3 shows curves giving, according to the frequency, the impedance matching of each of the antennas and the isolation between the two radiating elements.

The simulation results are given by the curves of FIG. 3 which show the impedance matching parameters S11 and S22 according to the frequency of the two radiating elements and isolation S21 according to the frequency between the two radiating elements. The curves of FIG. 3 show an isolation of only 11.5 dB for operating frequencies of 2.4 GHz.

Figure 4:
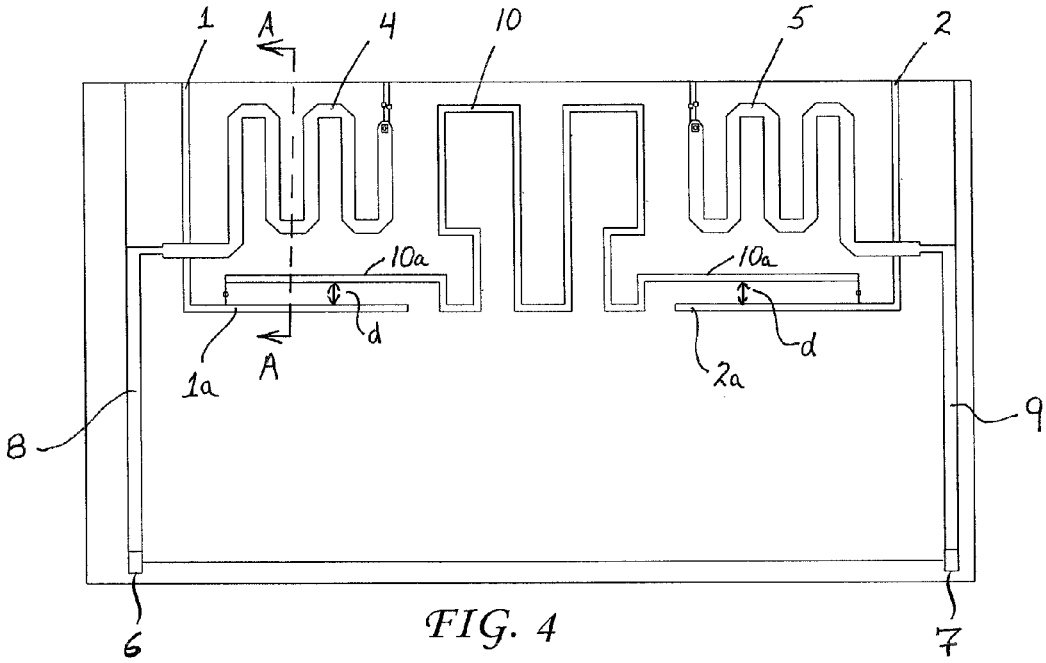
FIG. 4 is a diagrammatic top plan view of an antenna system in accordance with the present invention.
Figure 4A:
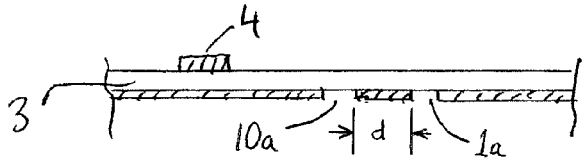
FIG. 4*a* is a cross-sectional view of the antenna system of FIG. 4, taken along line A-A.

In accordance with the present invention and as shown in FIG. 4, a transmission line 10 constituted by a slot line is placed between the two radiating elements 1, 2 to form, as explained with reference in FIG. 1, a coupling element with the radiating elements.

More precisely, and as shown in FIG. 4, the two radiating elements 1, 2 comprise a slot portion 1*a*, 2*a* which corresponds to the part folded to 90° to limit the system size. Each extremity 10*a* of the transmission line 10 is positioned parallel to the slot portions 1*a*, 2*a* of the radiating elements 1 and 2 of the antenna system. The length L of the part 10*a* and the distance d between the element 10*a* of the transmission line and the portions respectively 1*a* and 2*a* of the radiating elements are chosen to make a coupling with each of the radiating elements as explained with reference to FIG. 1.

Moreover, to allow its integration between the two radiating elements 1 and 2, the transmission line 10 is curved, as shown in FIG. 4. The length L' of the transmission line 10 between the two coupling elements is chosen to optimize the isolation between the two radiating elements 1 and 2 by compensating for the phase shift $\phi$ as will be explained in a more detailed manner hereafter.

Figure 5:
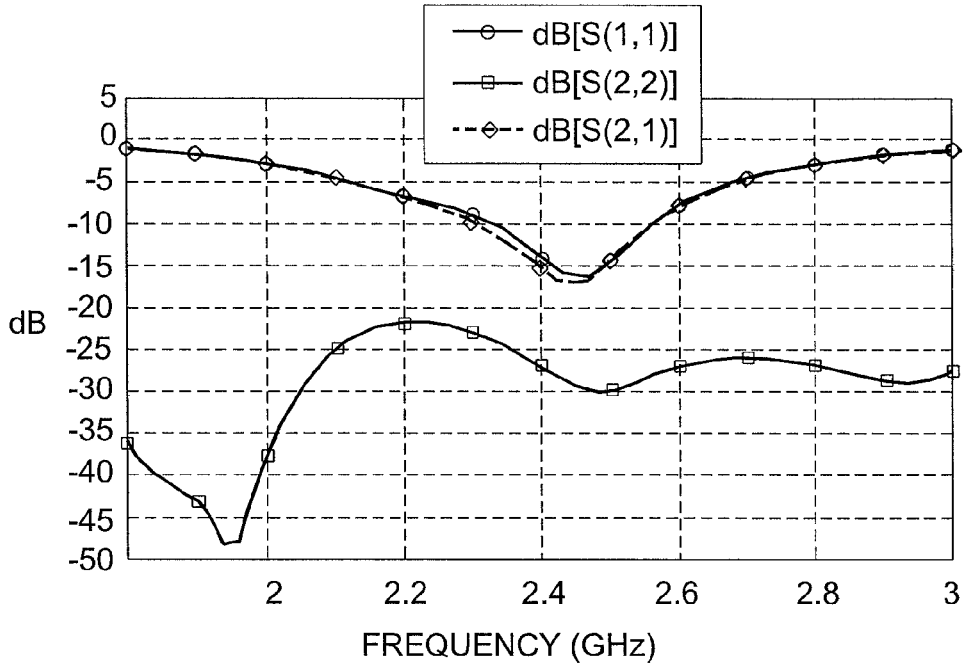
FIG. 5 shows the impedance matching and isolation curves of the system of FIG. 4 according to the frequency.

The structure shown in FIG. 4 is an example of optimized configuration for the transmission slot line and for the two radiating elements in order to minimize the total size of the antenna system. This structure has been simulated like the structure of FIG. 2. The simulation results are shown in FIG. 5.

It is noted that the 50 Ohm impedance matching on the two ports 6 and 7 is greater than −14 dB in the frequency band corresponding to the 802.11b, g standard, namely the 2.4 GHz band. The isolation between the two accesses is greater than 27 dB in the frequency band considered whereas, as mentioned with reference in FIG. 2, without the slotted transmission line, the isolation was only 11.5 dB for the same size.

The influence of various parameters, such as the distance d between the ends 10*a* of the transmission line and the portions 2*a* and 1*a* of the slot type radiating elements and the length of the transmission line with respect to the desired result will be shown hereafter with reference to FIGS. 6 to 9.

Figure 6A:
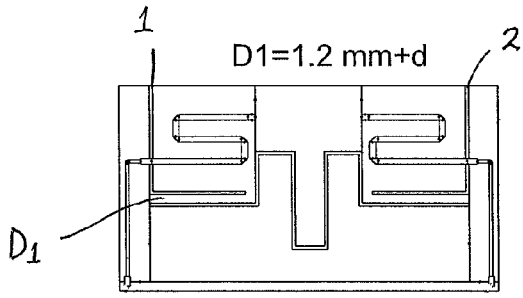
FIG. 6 diagrammatically shows various embodiments of the present invention in which the distance D has been varied between the parallel parts of the transmission line and of the radiating elements.

FIG. 6 allows the impact of the coupling of slot type radiating elements to the slot type transmission line to be shown by the adjustment of the distance d between the two extremities 10*a* and the portions of slots respectively 2*a*, 1*a*, as shown in FIGS. 6*a, b, c, d*. In this case, the length L of the slot portion at the coupling level is fixed and is equal to 52 mm whereas D varies in steps of 0.6 mm with d=1 mm, the optimum distance.

Figure 6B:
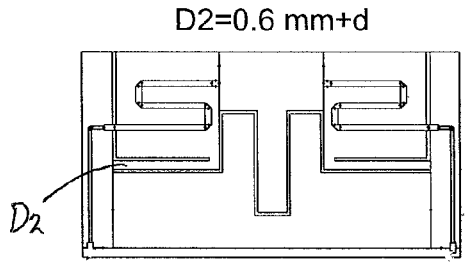
Figure 6C:
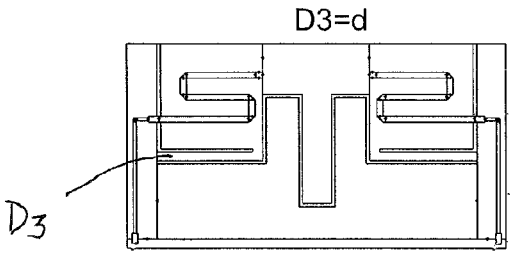
Figure 6D:
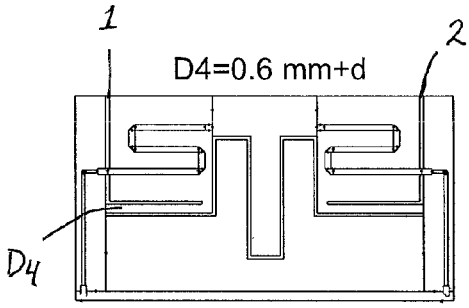

FIG. 6*a* corresponds to a distance D1 equal to the distance d+1.2 mm. FIG. 6*b* corresponds to D2=d+0.6 mm. FIG. 6*c* corresponds to D3=d, optimum distance and FIG. 6*d* corresponds to D4=d−0.6 mm.

Figure 7A:
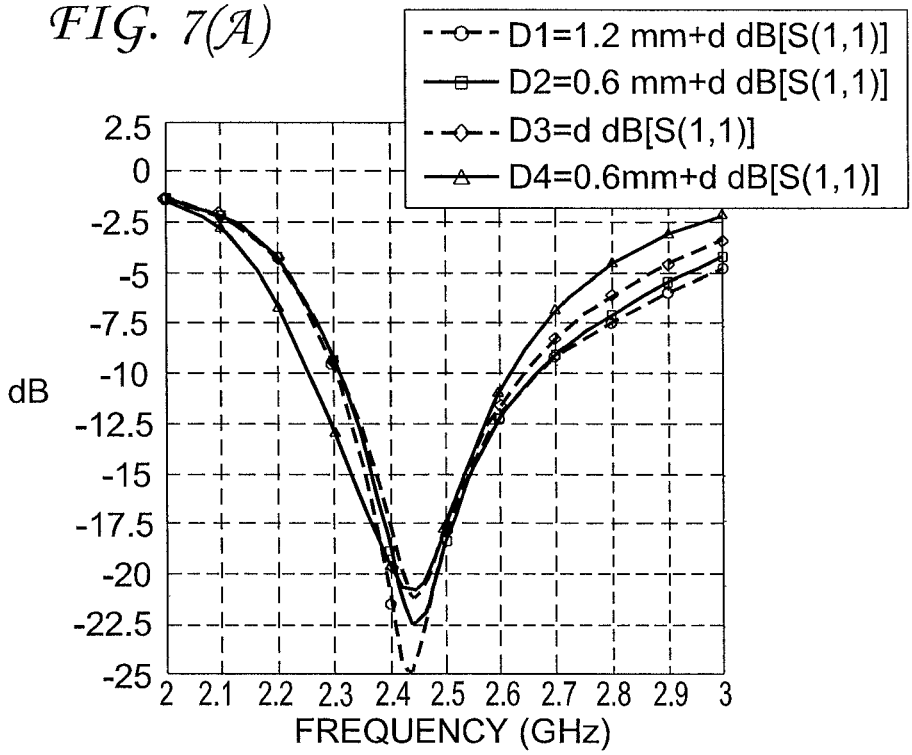
FIGS. 7*a* and 7*b* respectively show in a) the impedance matching curves according to the frequency and to the value of D and b) the isolation curves between the two radiating elements according to the distance D.
Figure 7B:
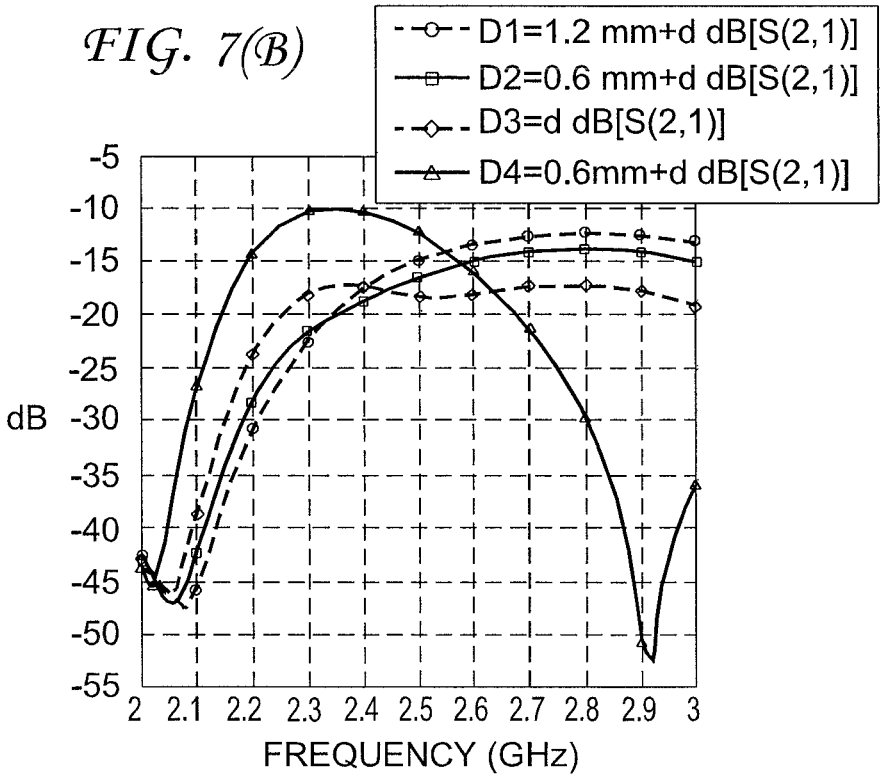
Figure 8A:
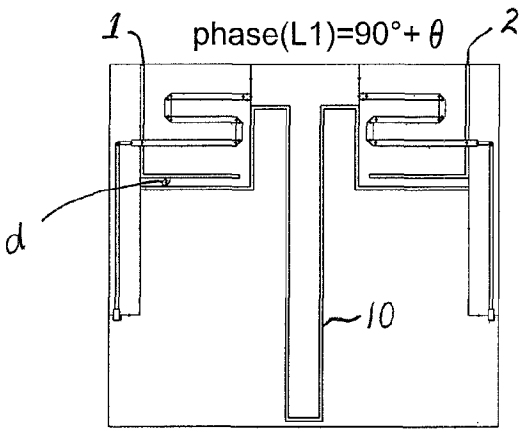
FIG. 8 is a diagrammatic representation of various embodiments of the invention according to the electrical length $\theta$ of the transmission line.
Figure 8B:
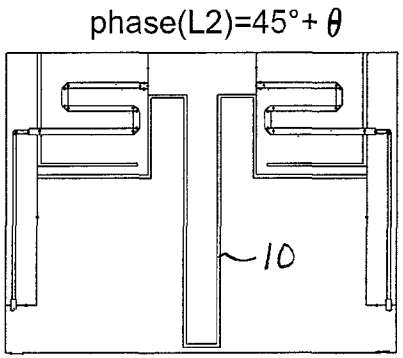
Figure 8C:
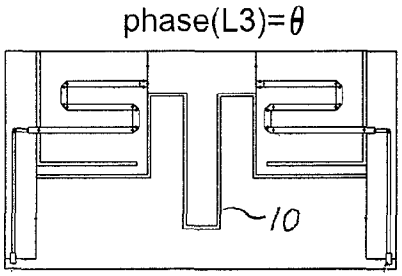
Figure 8D:
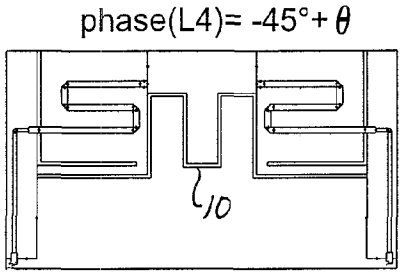
Figure 8E:
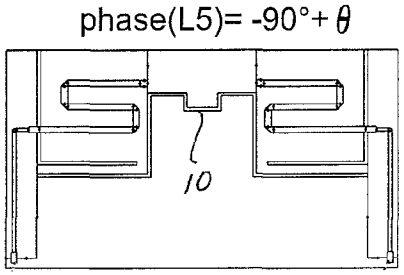

On FIGS. 7*a* and 7*b*, for each of the four configurations D1, D2, D3, D4 above, the 50 Ohm impedance S11 matching curve for a slot type radiating element in the 2.4 GHz band and the S12 insulation curve between the two slot type radiating elements in the same band have been represented.

These curves show that, for an impedance matching level better than −17 dB, the adjustment of the distance D allows to obtain an optimum isolation better than 17.5 dB.

On FIG. 8, various lengths and positions for the slot type transmission line integration between the radiating elements have been shown, to show the influence of the physical length and therefore of the slot line phase coupled to the two radiating elements. The phase of the slot line between the two couplers varies from 90°+θ (L1 configuration) to −90°+θ (L5 configuration) in steps of 45° (L2, L3, L4 configurations), where the value of θ is 225° at the 2.45 GHz frequency, i.e. a length of 52 mm. For the five L1, L2, L3, L4, L5 configurations shown in FIG. 8, the distance between the extremities of the transmission slot line and the portions of the radiating slots is identical and equal to d=1 mm.

Figure 9A:
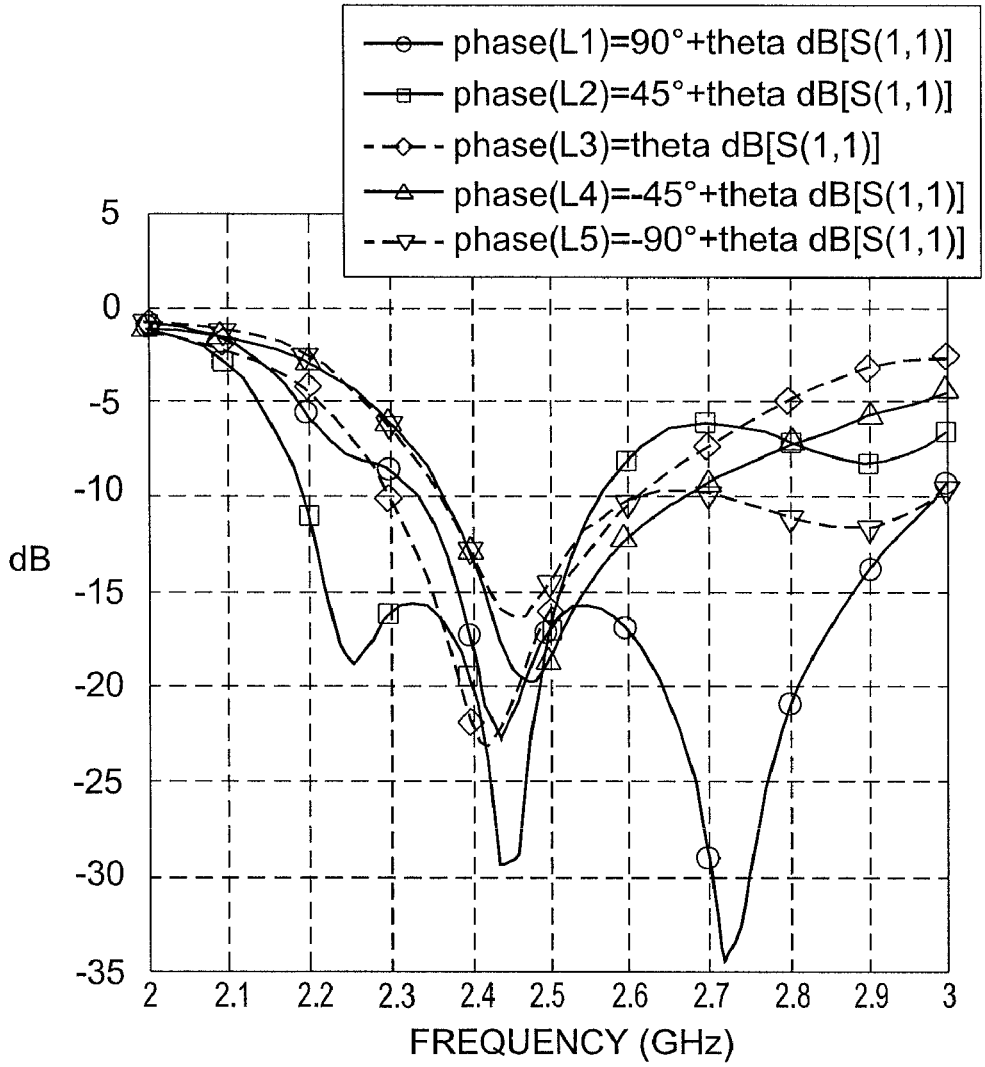
FIGS. 9*a* and 9*b* respectively show the impedance matching and isolation curves of the various embodiments of FIG. 8.
Figure 9B:
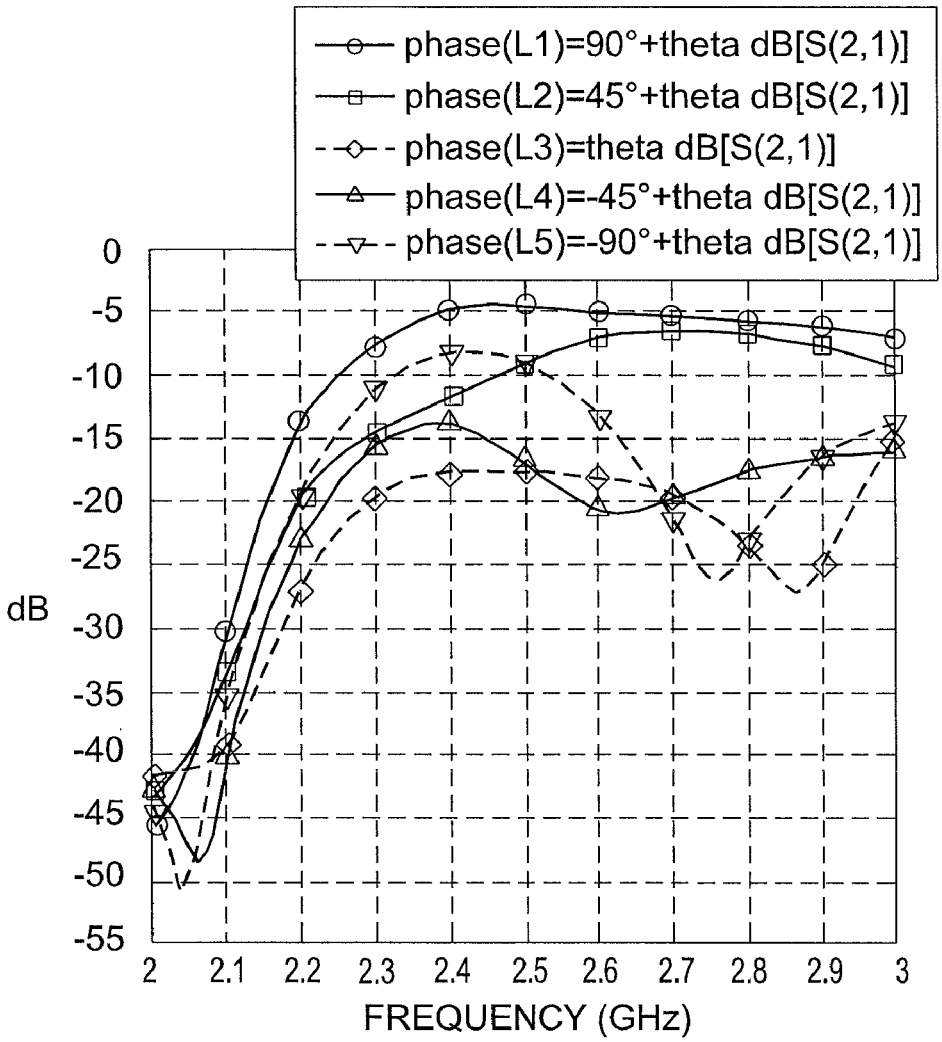

For each of these five configurations, FIGS. 9*a* and 9*b* show respectively the 50 Ohm impedance matching curve with access of a radiating element in the 2.4 GHz band and isolation curve between the two radiating elements in the same frequency band. These curves show that, for an impedance matching level better than −12 dB, the adjustment of the length of the slot type transmission line allows an optimum isolation better than 18 dB to be obtained.

Another embodiment of the present invention will now be described with reference to FIGS. 10 and 11. In this case, each radiating element 20,21 consists of a tapered slot such as for example a Vivaldi type antenna. In a standard manner, the tapered slot is supplied by is electromagnetic coupling by a microstrip 22,23. In accordance with the present invention, a transmission line 24 constituted by a slot line is provided between the two tapered slots such that the extremities 24*a* of the slot line are parallel to the tapered edge 20*a* and 21*a* of the tapered slots. In this case, the coupling function takes place after the line/slot transition, i.e. on a part of the radiating element profile.

Figure 10:
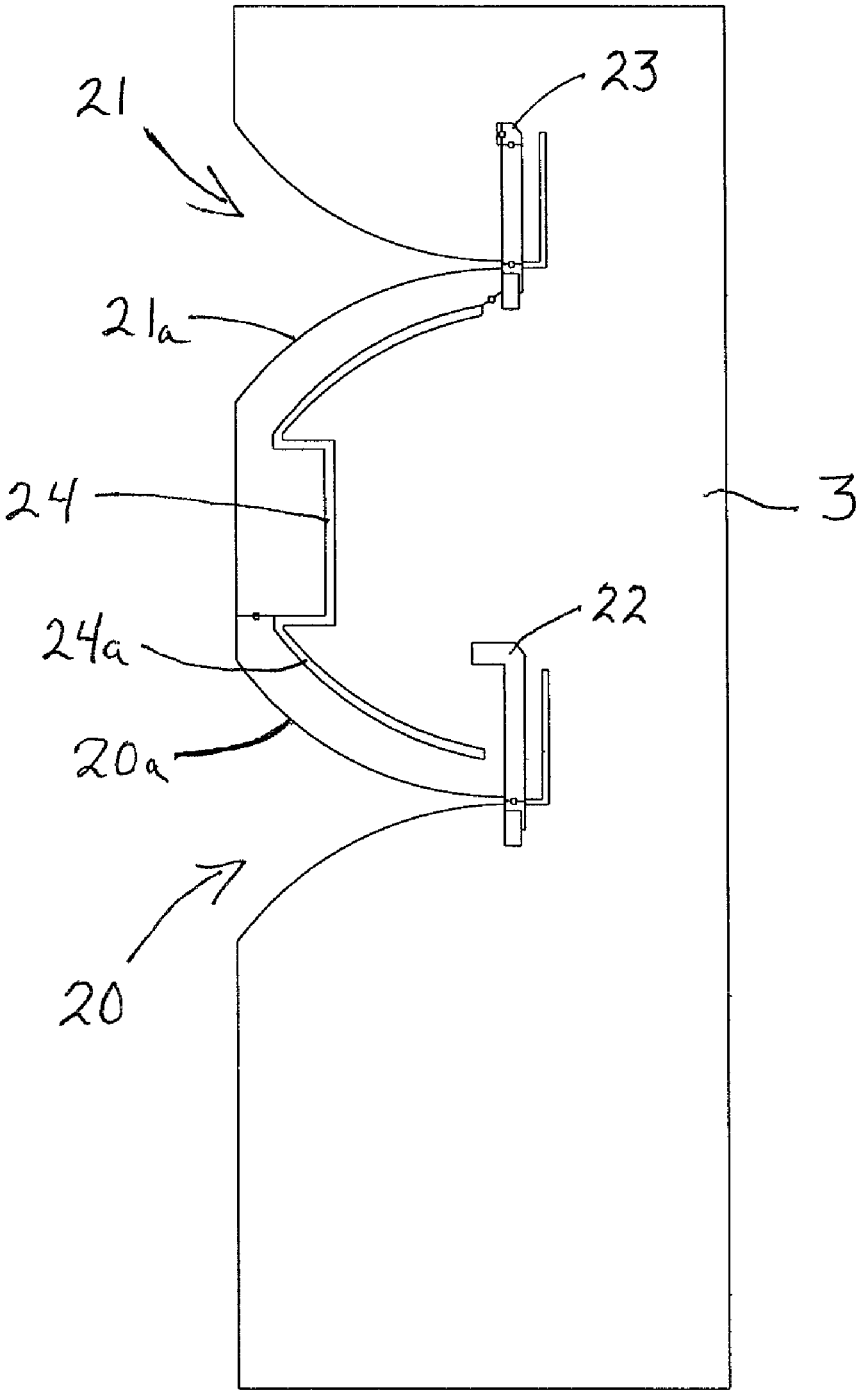
FIG. 10 is a diagrammatic top plan view of an antenna system in accordance with another embodiment of the present invention.
Figure 11A:
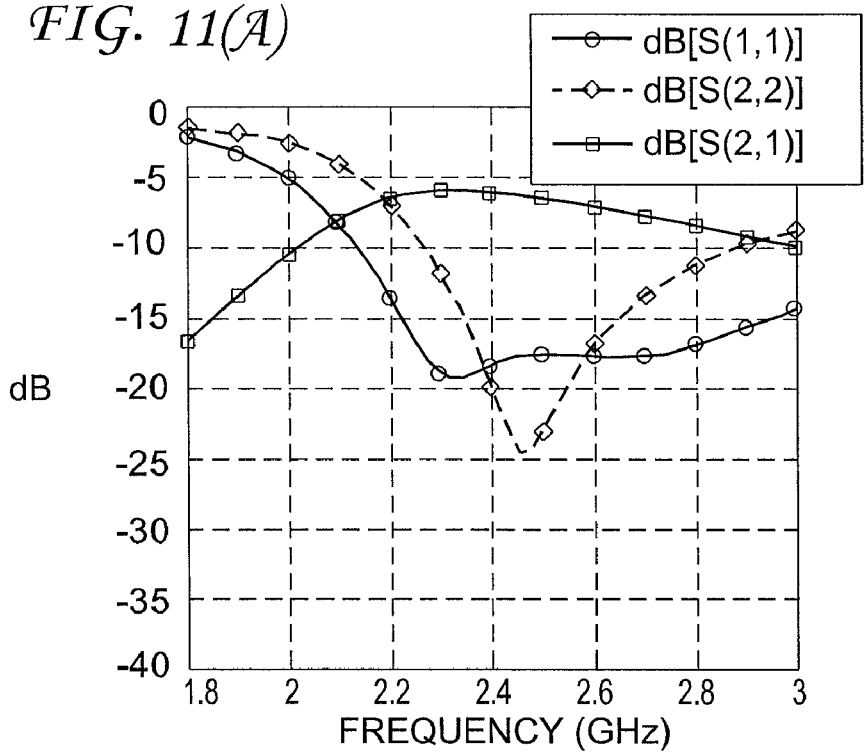
FIGS. 11*a* and *b* show the impedance matching and isolation curves according to the frequency respectively of an antenna system without a transmission line FIG. 11*a* and as shown on FIG. 10, FIG. 11*b*.
Figure 11B:
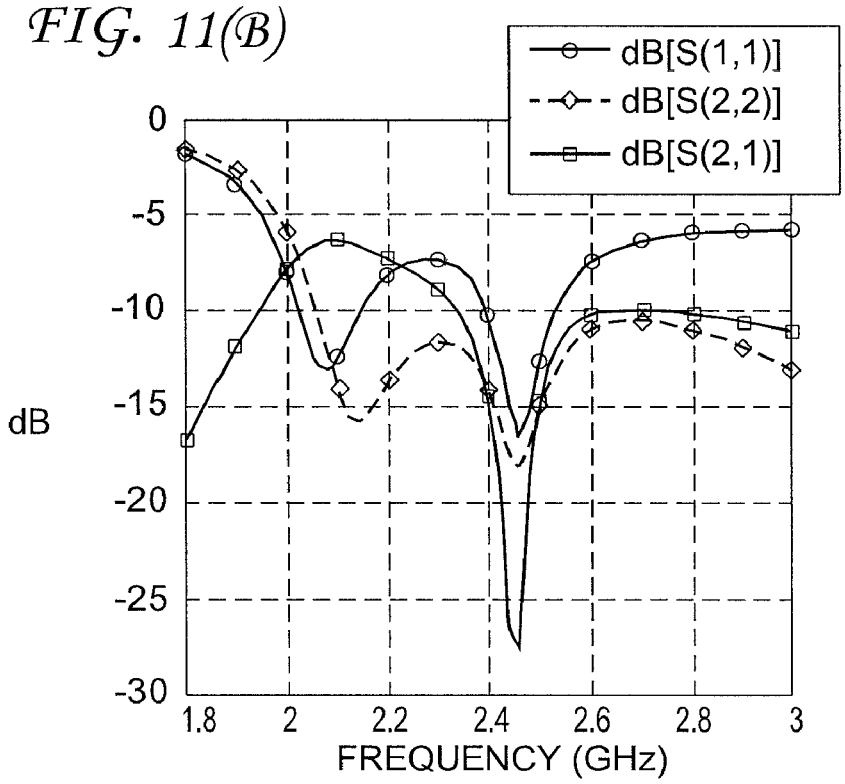

FIGS. 11-*a* and 11-*b* show respectively the parameters S of the configuration without transmission line and the configuration of FIG. 10. These curves show an impedance matching level better than −10 dB in the 2.4 GHz frequency band for the two configurations. So, according to the principle implemented in this configuration, the isolation between antennas, initially greater than 6 dB (FIG. 11-*a*), is improved to reach in this example a level greater than 19 dB.

Figure 12:
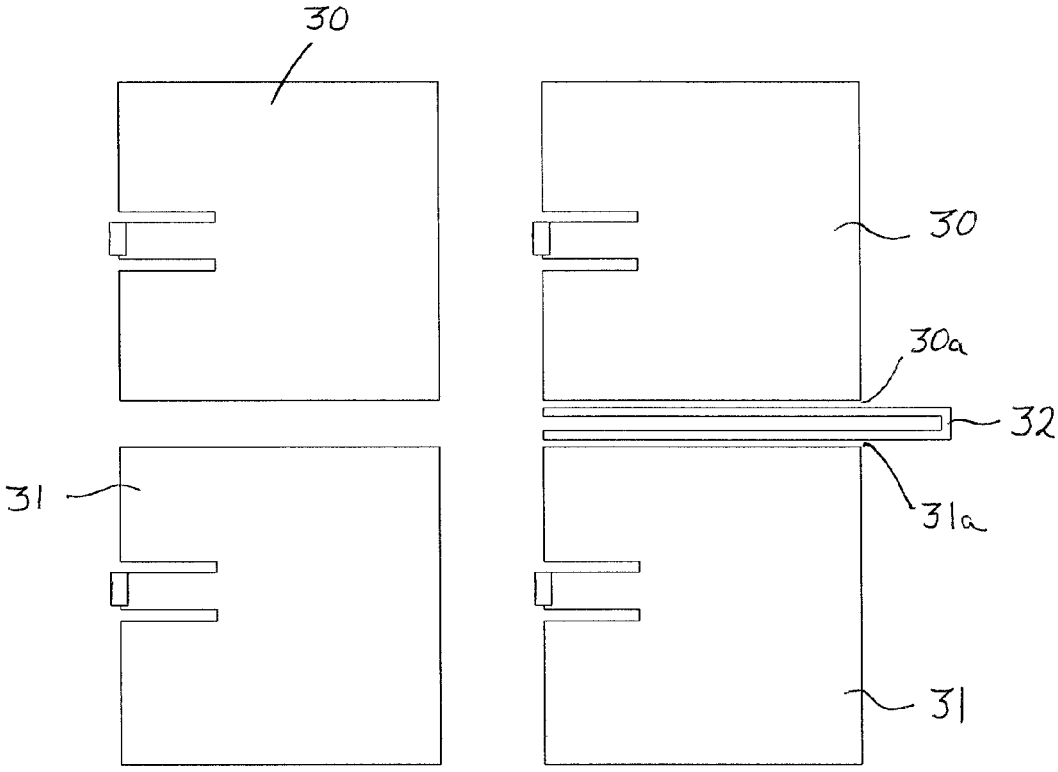
FIG. 12 is a diagrammatic top plane view of an antenna system in accordance with still another embodiment of the present invention.
Figure 13A:
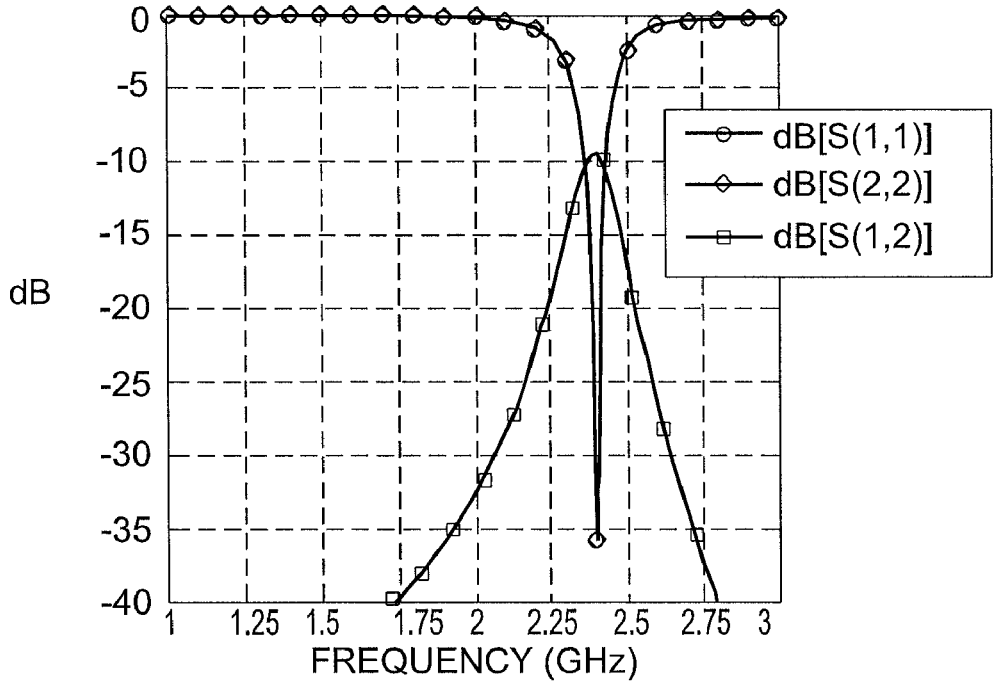
FIGS. 13*a* and *b* show the impedance matching and isolation curves according to the frequency respectively of an antenna system without a transmission line FIG. 13*a* and as shown on FIG. 12, FIG. 13 *b*.

Yet another embodiment of the present invention will now be described with reference to FIGS. 12 and 13. In this case, the radiating elements are constituted by patches 30 and 31. FIG. 12*a* shows two patches 30 and 31 of side 30 mm on a substrate FR4 with the same characteristics as above. The two patches are spaced by 4 mm from edge to edge. FIG. 13*a* shows the parameters S of such a structure, where the two patch antennas are matched to −10 dB around 2.45 GHz. The isolation around this frequency is −9.5 dB.

Figure 13B:
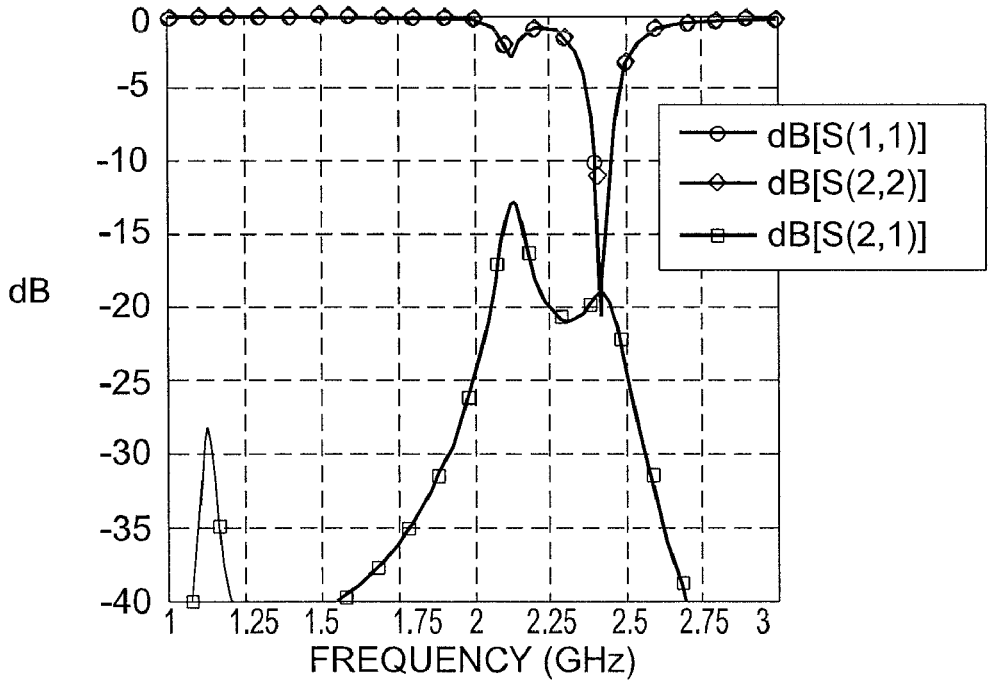

FIG. 12*b* shows two patches 30 and 31 in the same configuration as above. In this case, the coupling functions are placed on one of the sides 30*a* and 31*a* of the patch in order to have an electromagnetic coupling. The transmission line 32 between the two couplers C is a microstrip line, the length of which allows the isolation to be adjusted. FIG. 13*b* shows the parameters S of such a structure, where the two antennas are matched to −10 dB around 2.45 GHz. The isolation around this frequency is 19 dB, i.e. an improvement of almost 10 dB.

Other embodiments of the present invention will now be described with reference to FIGS. 14 to 17.

Figure 14:
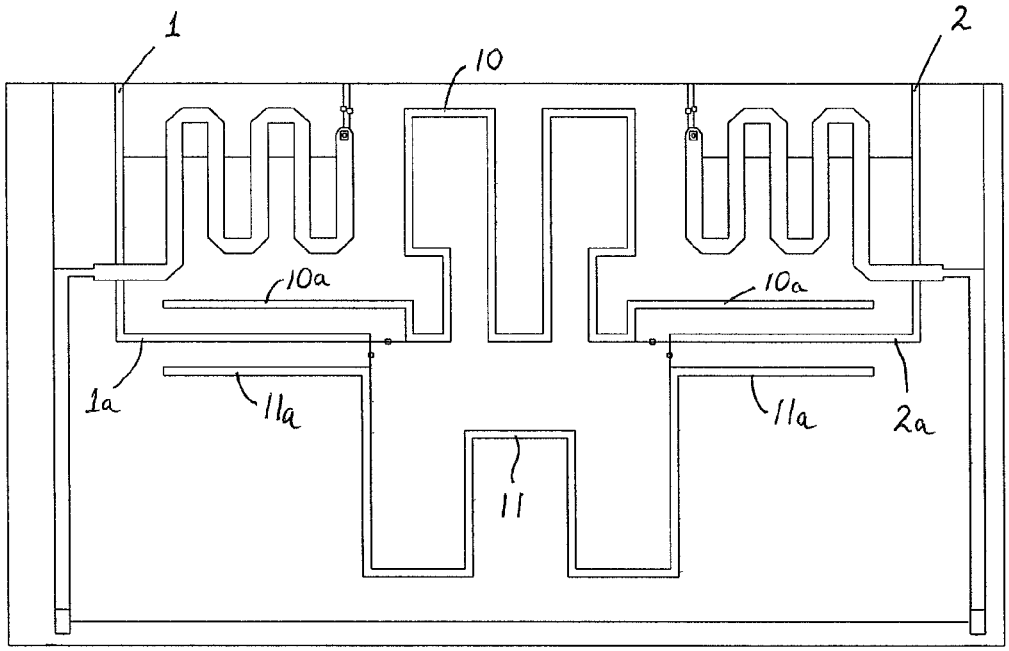
FIG. 14 is a diagrammatic top plane view of an embodiment variant of the present invention.

On FIG. 14, an antenna system such as shown in FIG. 4 is used. However, in this embodiment, a second slot type transmission line 11 is integrated in the same manner as the first transmission slot line 10 in an area such that that it is possible to make two couplers 11*a*, 10*a*, 1*a* and 11*a*, 10*a*, 2*a* and link them together by means of two transmission lines 10 and 11. The length of the transmission line and the distance between each transmission line and the radiating elements are adjusted in order to reject either a frequency close to the antenna operating frequency, or a more distant frequency to reject a frequency which is undesirable for the operation of the antenna system. In the case where the transmission line is a slot line, this can be done between the line/slot transition and the short-circuit plane of the slot type radiating element 1, 2 or on the other side of the line/slot transition.

Figure 15:
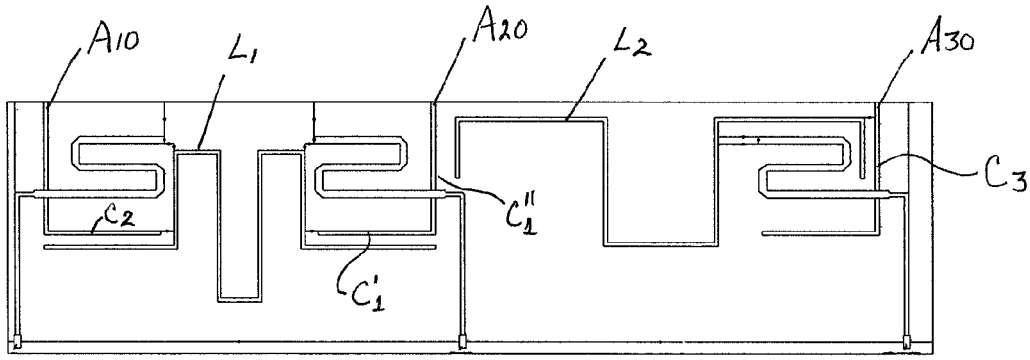
FIG. 15 is a diagrammatic top plane view of another embodiment variant of the present invention.

In FIG. 15, another embodiment with 3 radiating elements A10, A20, A30 has been shown; the element in the middle A20 must be isolated from the other two elements.

Hence, in comparison with FIG. 4, a third quarter wave slot A30 is added as shown in FIG. 15. Two coupling functions (C1' and C1") are arranged on the radiating element A20 and a coupling function (C2 and C3) on each of the other two radiating elements A10 and A30. A first slot line L'1 links coupling functions C1' to C2 respectively of the radiating element A10 and the radiating element A20. A second slot line L'2 links coupling functions C1' to C3 respectively of the radiating element A10 and of the radiating element A30. The second slot line L'2 is integrated in the same manner as the first slot line L'1 in an area such that it is possible to place two couplers and link them together by means of a transmission line.

Figure 16A:
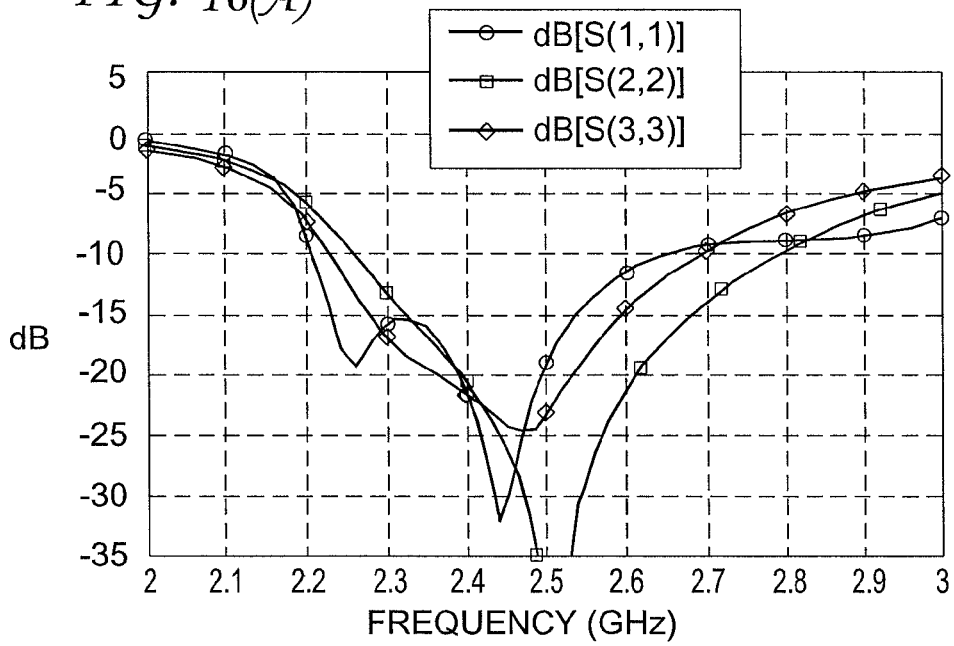
FIGS. 16*a* and *b* and FIGS. 17*a* and *b* respectively show the impedance matching curves (curves a) and the isolation curves (curves b) of the embodiment of FIG. 15 with no transmission line and with the transmission lines as shown in FIG. 15.
Figure 16B:
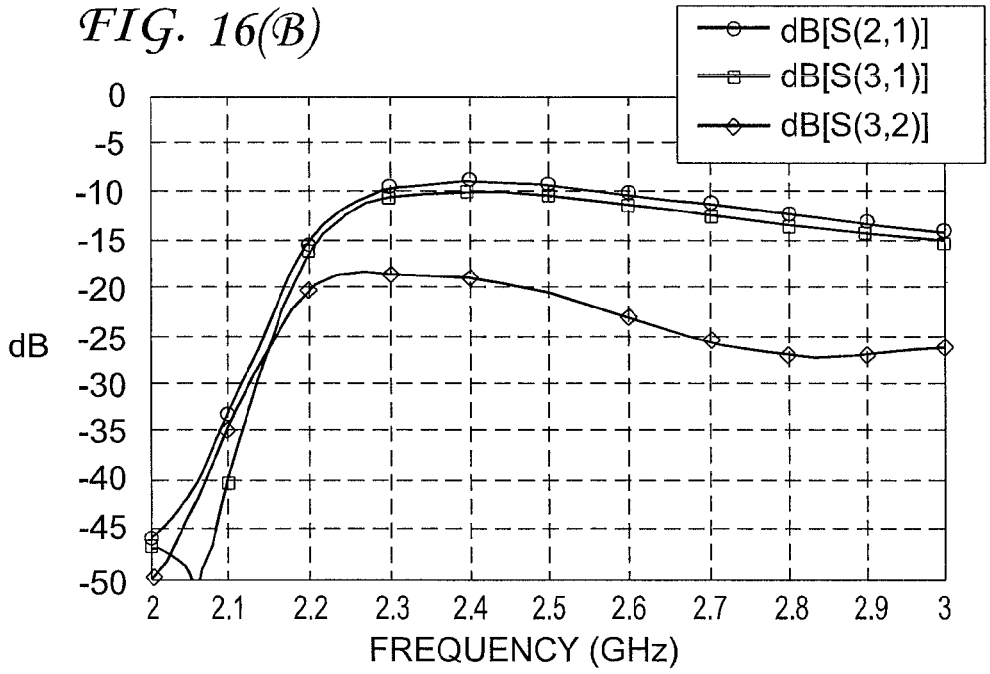
Figure 17A:
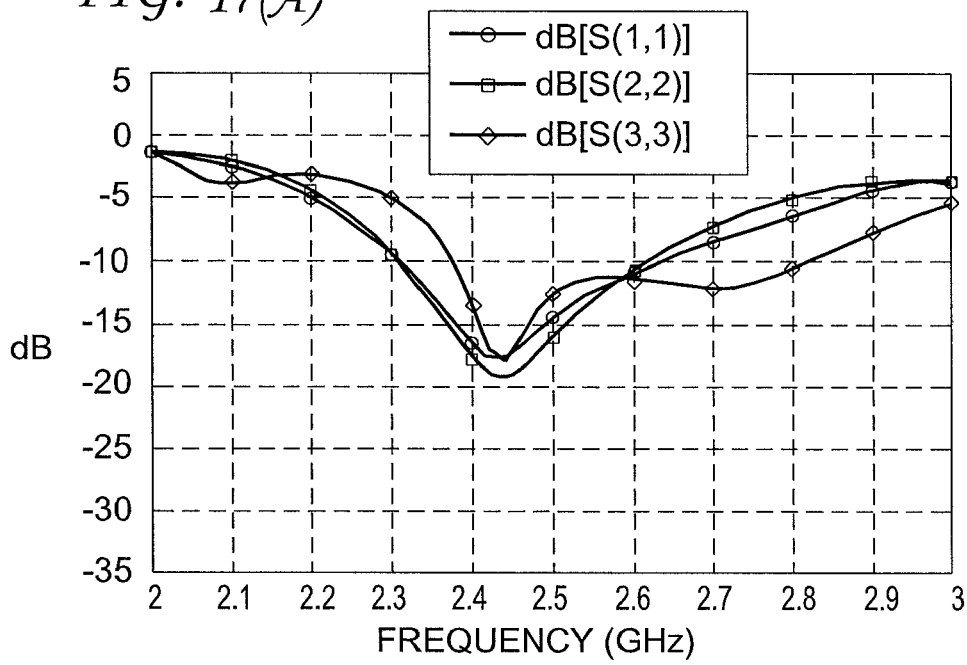
Figure 17B:
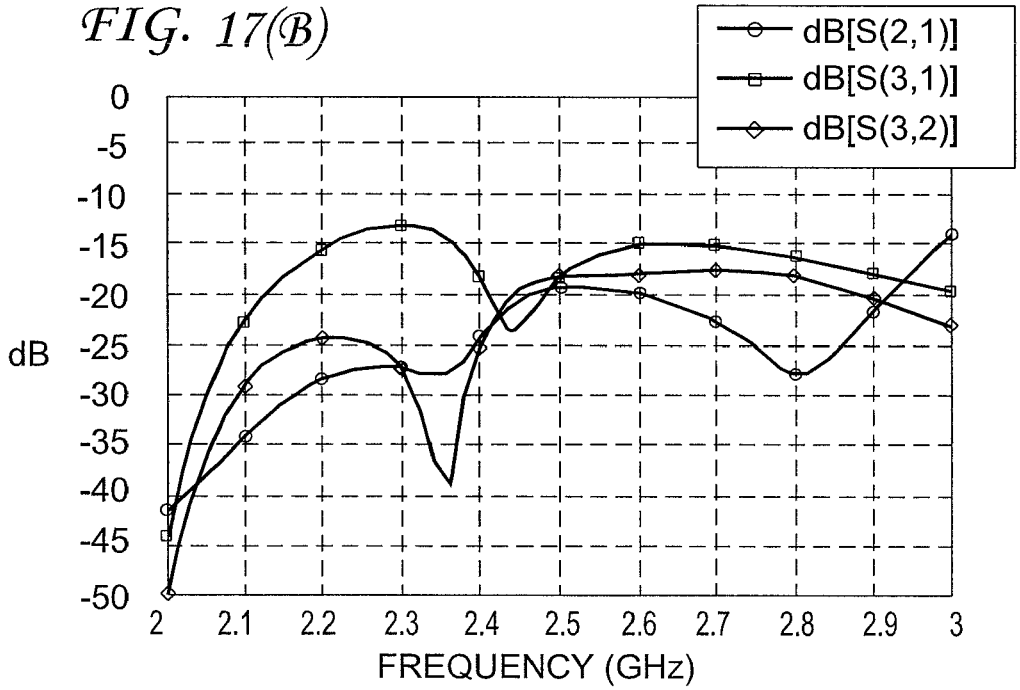

FIGS. 16*a* and 16*b* show the parameters S of the configuration of FIG. 15 but without a transmission line whereas FIGS. 17*a* and 17*b* show the same parameters but for the configuration of FIG. 15. As shown in FIGS. 17*a* and 17*b*, the 50 Ohm impedance matching in the 2.4 GHz frequency band is better than 13 dB. Hence, according to the principle implemented in this configuration, the isolation between antennas, initially greater than 9 dB (FIG. 16-*a*) is improved to reach in this example a level greater than 18 dB.

The invention claimed is:

1. An antenna system comprising on a substrate, at least a first and a second radiating elements, each radiating element being supplied by a feed line, with, between the first and the second radiating elements, at least one transmission line comprising a first extremity part and a second extremity part, wherein the first and the second extremity parts of the transmission line are respectively coupled to a portion of the first and the second radiating elements according to a coupling function with a ratio 1:b, b>1 and a phase ϕ, linked to the physical difference between the radiating elements, the length of the transmission line bringing a phase difference θ such that the phase difference θ compensates for the phase ϕ.

2. System according to claim 1, wherein the radiating element is constituted by an antenna of the slot type.

3. System according to claim 1, wherein the radiating element is constituted by an antenna of the patch type.

4. System according to claim 1, wherein the transmission line is a slot line.

5. System according to claim 1, wherein the transmission line is a microstrip line.

6. System according to claim 1, wherein the element providing the coupling function is formed by a portion of the radiating element parallel to the extremity part of the transmission line.

7. System according to claim 1, wherein the coupling depends on a length L of the portions of the radiating element in parallel with the extremity part of the transmission line and on the distance d between said portions and said extremity part.

* * * * *